US005724776A

United States Patent [19]

Meadows, Jr.

[11] Patent Number: 5,724,776

[45] Date of Patent: Mar. 10, 1998

[54] DECORATION DEVICE

[76] Inventor: John L. Meadows, Jr., 15 Elvira Dr., Rockfall, Conn. 06481

[21] Appl. No.: 395,920

[22] Filed: Feb. 28, 1995

[51] Int. Cl.[6] ..... E04D 13/15

[52] U.S. Cl. ..... 52/94; 52/311.1; 52/60; 52/11

[58] Field of Search ..... 52/11, 15, 58, 52/94, 311.1; D25/138, 139, 141, 142, 164, 199

[56] References Cited

U.S. PATENT DOCUMENTS

| | | | |
|---|---|---|---|
| D. 22,832 | 10/1893 | Bryant | D25/164 |
| 25,052 | 1/1859 | Bryant | D25/164 |
| D. 302,045 | 7/1989 | Gazley | D25/164 X |
| D. 343,014 | 1/1994 | Covini | D25/164 X |
| 3,939,616 | 2/1976 | Schapker | 52/94 |
| 4,067,152 | 1/1978 | Wolma | 52/58 X |
| 4,404,777 | 9/1983 | Lolley et al. | 52/94 X |
| 4,419,850 | 12/1983 | Butzen | 52/94 X |
| 4,581,857 | 4/1986 | Harbom | 52/11 X |
| 4,598,507 | 7/1986 | Hickman | 52/94 |
| 4,800,689 | 1/1989 | Lane | 52/94 X |
| 4,848,045 | 7/1989 | Nichols et al. | 52/94 X |
| 5,345,727 | 9/1994 | McCrea | 52/11 |

*Primary Examiner*—Carl D. Friedman
*Assistant Examiner*—Yvonne Horton-Richardson
*Attorney, Agent, or Firm*—Fishman, Dionne, Cantor & Colburn

[57] ABSTRACT

In accordance with the present invention, strips of a gutter decoration are piece-wise end-to-end (or seamlessly) attached to a gutter mounted to a building or structure to decoratively cover the gutter. The gutter decoration strip extends horizontally and cross sectionally comprises a first generally vertical section and a second section depending upwardly therefrom. The first vertical section includes a series or pattern of decorative features formed therein. The gutter decoration strip further includes means for attaching the strip to the gutter. Alternatively, the gutter decoration is attached below the gutter to either the fascia board or the gutter. In accordance with another embodiment of the present invention, strips of a fascia decoration are piece-wise end-to-end attached to a fascia board of a building or structure to decoratively cover the fascia board. The fascia decoration strip has a generally elongated rectangular shape with a lower portion thereof including a series or pattern of decorative features formed therein. The fascia decoration strip further includes means for attaching the strip to the fascia board.

16 Claims, 6 Drawing Sheets

DECORATION DEVICE

BACKGROUND OF THE INVENTION

The present invention relates generally to decorative devices. More specifically, the present invention relates to gutter and fascia decoration.

Gutters are typically attached to a fascia board of a building or structure (e.g., a house). The structure including a roof having shingles which overhangs the fascia board, whereby rain runs off of the roof into the gutter, as is well known. Gutters are typically available in a variety of colors and such is generally selected to blend in with the color of the fascia board to make the gutters less noticeable. Gutters are also available in a variety of shapes having various outer contoured surfaces in an attempt to make the gutters more aesthetically appealing. Nevertheless, gutters are a purely functional element of a structure and are commonly viewed as distracting from the aesthetics of the structure. Further, the fascia board is typically a plane straight board which serves to cover the joint between the top of a wall and the projecting eaves of the structure. Accordingly, the fascia board does not generally improve the aesthetics of the structure.

SUMMARY OF THE INVENTION

The above discussed and other drawbacks and deficiencies of the prior art are overcome or alleviated by the decoration device of the present invention.

In accordance with the present invention, a gutter decoration comprises a plurality of strips which are piece-wise end-to-end (or seamlessly) attached to a gutter mounted to a building or structure to decoratively cover the gutter. The decoration strip extends horizontally and cross sectionally comprises a first generally vertical section and a second section depending upwardly therefrom. The first vertical section includes a series or pattern of decorative features formed therein. The decoration strip further includes means for attaching the strip to the gutter. Alternatively, the gutter decoration is attached below the gutter to either the fascia board or the gutter.

The gutter decoration of the present invention decoratively covers or accents the gutters on a structure, whereby the aesthetics of the structure is enhanced by the gutter decoration of the present invention rather than diminished by the unsightly gutters.

In accordance with another embodiment of the present invention, a fascia decoration comprises a plurality of strips which are piece-wise end-to-end attached to a fascia board of a building or structure to decoratively cover the fascia board. The fascia decoration strip has a generally elongated rectangular shape with a lower portion thereof including a series or pattern of decorative features formed therein. The fascia decoration strip further includes means for attaching the strip to the fascia board.

The fascia decoration of the present invention decoratively covers the fascia board on a structure, whereby the aesthetics of the structure is enhanced by the fascia decoration of the present invention.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
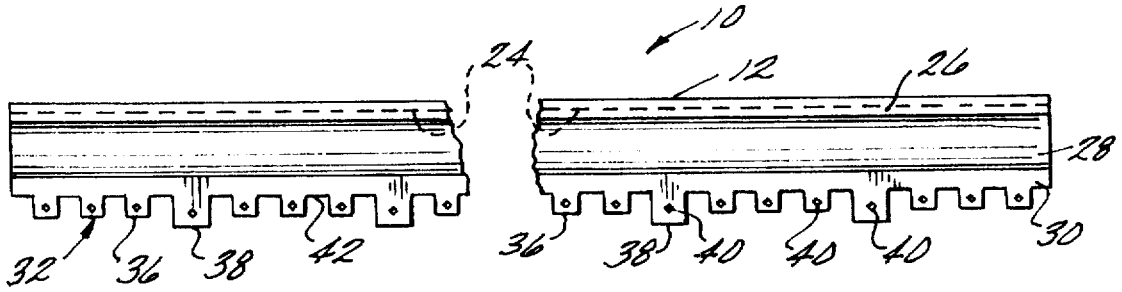
FIG. 1 is a front elevational view of a strip of gutter decoration in accordance with the present invention.
Figure 2:
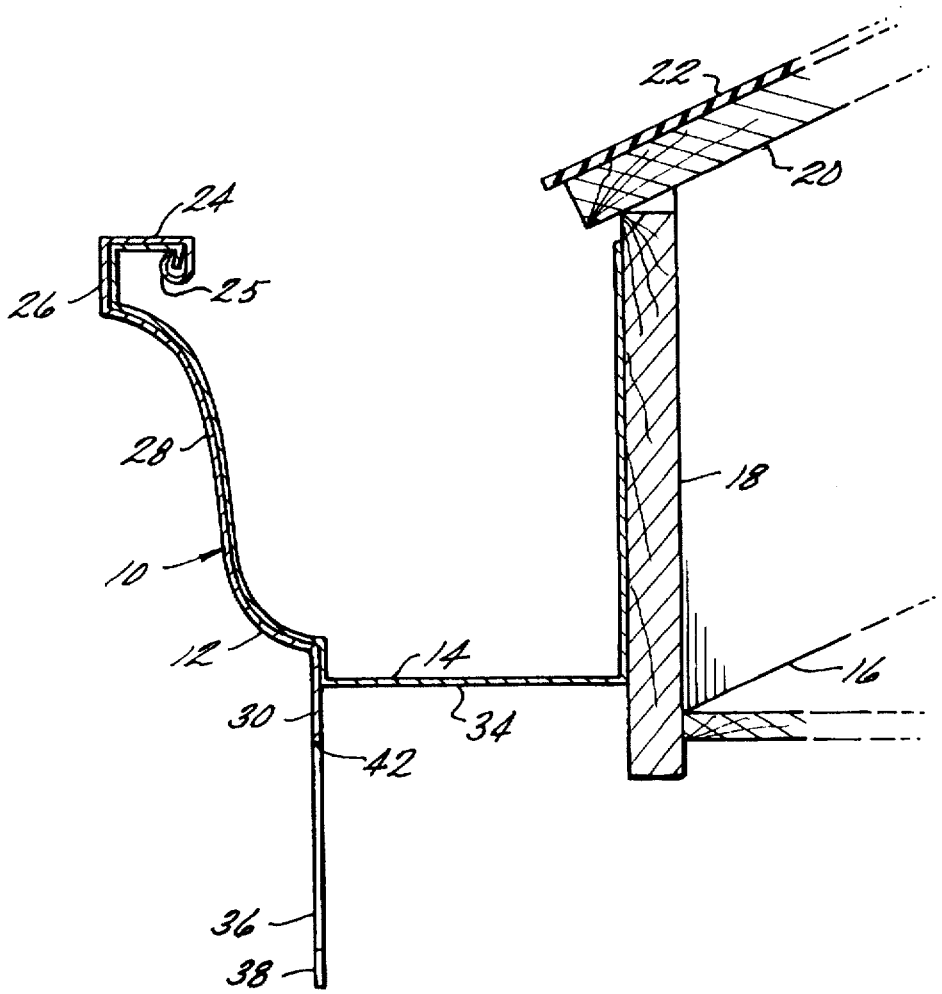
FIG. 2 is a cross sectional view of the strip of gutter decoration of FIG. 1 attached to a gutter mounted to a structure in accordance with the present invention.

Referring to FIGS. 1 and 2, a strip of gutter decoration in accordance with the present invention is shown generally at 10. Decoration 10 comprises a strip or section 12 of a standard length (e.g., 6', 8', or 12'), a plurality of which are piece-wise end-to-end (or seamlessly) attached to a gutter 14 mounted to a building or structure 16 (e.g., a house). Typically, gutter 14 is attached to a fascia board 18 of structure 16 with a roof 20 having shingles 22 overhanging the fascia board 18, whereby rain runs off of the shingles 22 into the gutter 14, as is well known. Accordingly, decoration 10 covers gutter 14 and fascia board 18 to provide a desired decorative feature.

Decoration strip 12 extends horizontally and cross sectionally comprises a generally inverted U-shaped channel 24 at the upper end thereof with an upwardly turned clip portion 25, which depends upwardly from a vertical section 26. A section 28 depends downwardly (sections 26 and 28 roughly follow the contour of gutter 14) from section 26, to a generally vertical section 30. U-shaped channel 24 with clip portion 25 are disposed over the outer upper end of gutter 14 for attaching decoration strip 12 to gutter 14. Vertical section 30 includes a series or pattern of decorative features 32 formed therein. It is preferred that all openings in the decorative features 32 be formed below the bottom surface 34 of gutter 14, so that the gutter is completely covered by decoration strip 12.

Decorative features 32, in the present example, comprise a repeating series of cut out tabs 36 and 38 having diamond shaped cut outs 40 therein. In accordance with the above preferred requirement, the top edge 42 of the cut outs is not above the bottom surface 34 of gutter 14.

Figure 3:
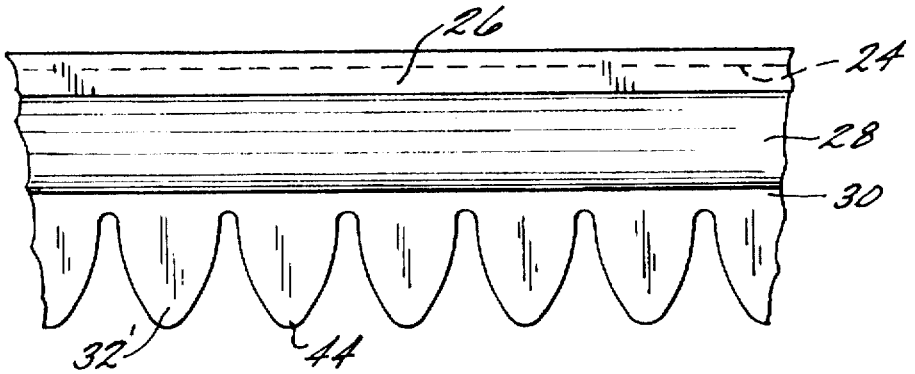
FIG. 3 is a front elevational view of a portion of a strip of gutter decoration in accordance with an alternate embodiment of the present invention.

Referring to FIG. 3, an alternate decorative feature 32' is shown comprising a series of scallops 44. Again, the intersection of these cut out scallops 44 do not extend above the bottom surface 34 of gutter 14.

It will be appreciated that the above examples of the decorative feature are only exemplary and are not intended to provide all possible decorative features that may be employed by and that are within the scope of the present invention. It will also be appreciated, that many other decorative features will readily come to mind to one of ordinary skill in the art.

Figure 4:
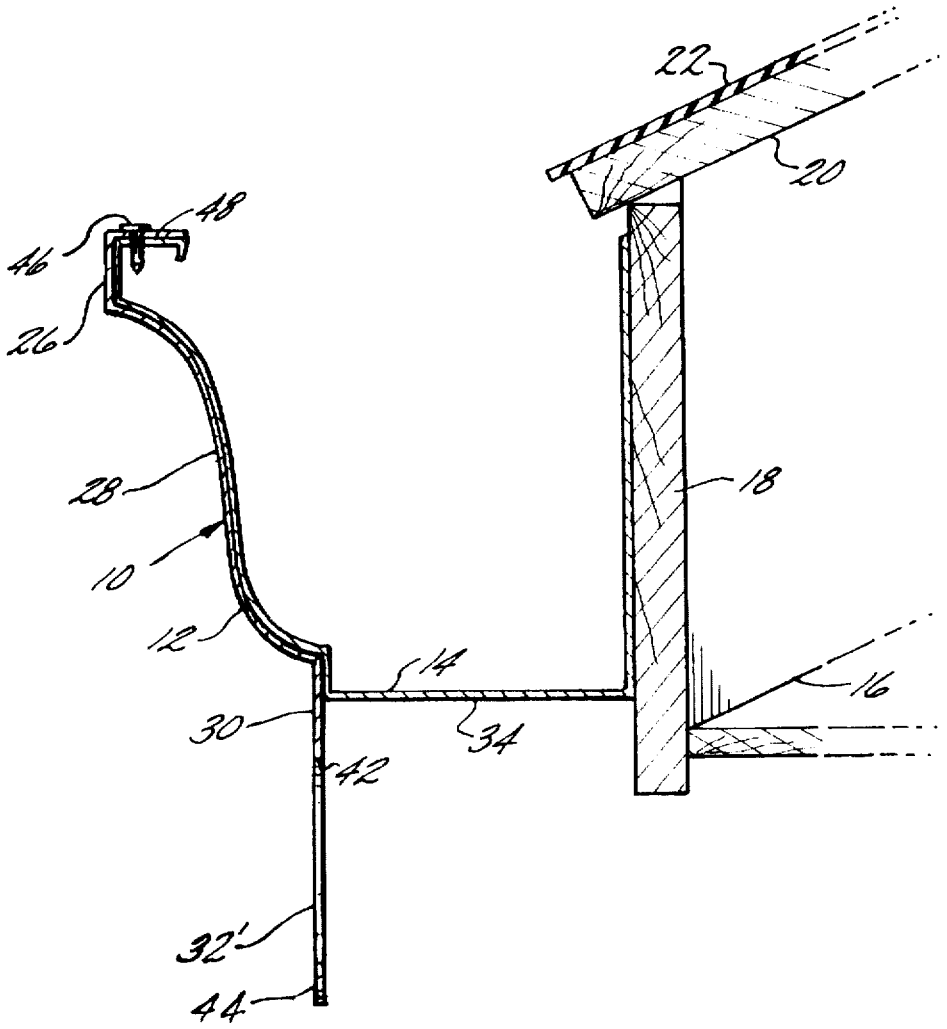
FIG. 4 is a cross sectional view of the strip of gutter decoration of FIG. 3 attached to a gutter mounted to a structure in accordance with an alternate embodiment of the present invention.

Referring to FIG. 4, in an alternate embodiment, U-shaped channel 24 and clip portion 25 may be replaced by a plurality of fasteners 46 as a means for attaching decoration strip 12 to gutter 14. In accordance with which, portion 26 extends upwardly and is bent over the top of gutter 14. Fasteners 46 may comprise sheet metal screws, rivets or any other suitable type fasteners.

Decorative strip 12 is preferably formed from a flat sheet of aluminum which is stamped and bent to the configurations described herein, as is well known in the art. Alternatively, decorative strip 12 is formed by vinyl extrusion, or any other suitable means.

Figure 5:
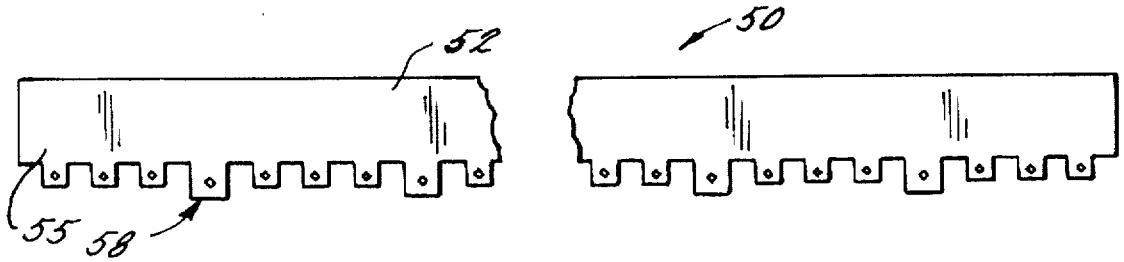
FIG. 5 is a front elevational view of a strip of fascia decoration in accordance with another embodiment of the present invention.
Figure 6:
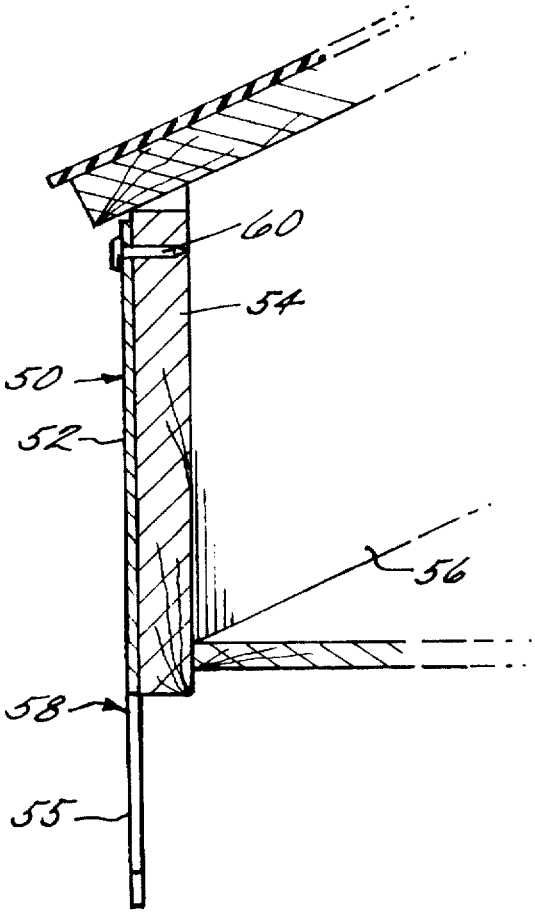
FIG. 6 is a cross sectional view of the strip of fascia decoration of FIG. 5 attached to a fascia board of a structure in accordance with the present invention.

In accordance with another embodiment of the present invention, referring to FIGS. 5 and 6, a strip of fascia decoration is shown generally at 50. Decoration 50 comprises a strip or section 52 of a standard length, a plurality of which are piece-wise end-to-end (or seamlessly) attached to a fascia board 54 of a building or structure 56 (e.g., a house). Fascia decoration 50 is preferably used with buildings that do not employ gutters. Nevertheless, it is within the scope of the present invention that a gutter could be attached to the fascia board having fascia decoration 50 thereon. Accordingly, decoration 50 covers fascia board 54 to provide a desired decorative feature.

Decoration strip 52 has a generally elongated rectangular shape with a lower portion 55 thereof including a series or pattern of decorative features 58 formed therein. While decorative features 58 are the same as decorative features 28, described above, it will be appreciated that this example is only exemplary and many other decorative features may be employed by and are within the scope of the present invention, as such will readily come to mind to one of ordinary skill in the art.

Lower portion 55 of decorative strip 52 is shown extending below the lower end of board 54, whereby decorative features 56 may have a more pronounced aesthetic affect, however, it is within the scope of the present invention that lower portion 55 terminate at fascia board 54. A plurality of fasteners 60 are provided as a means for attaching decoration strip 52 to fascia board 54. Fasteners 60 may comprise nails, screws, or any other suitable type fasteners. Alternatively, the decoration strip may be attached to fascia board 54 by a suitable adhesive.

Decorative strip 52 is preferably formed from a flat sheet of aluminum which is stamped to the configurations described herein, as is well known in the art. Alternatively, decorative strip 52 is formed by vinyl extrusion, or any other suitable means.

Figure 8:
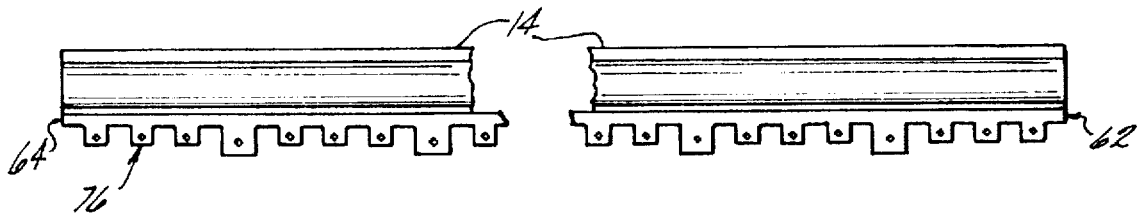
FIG. 8 is a front elevational view of a portion of the strip of gutter decoration of FIG. 7 in accordance with an alternate embodiment of the present invention.
Figure 7:
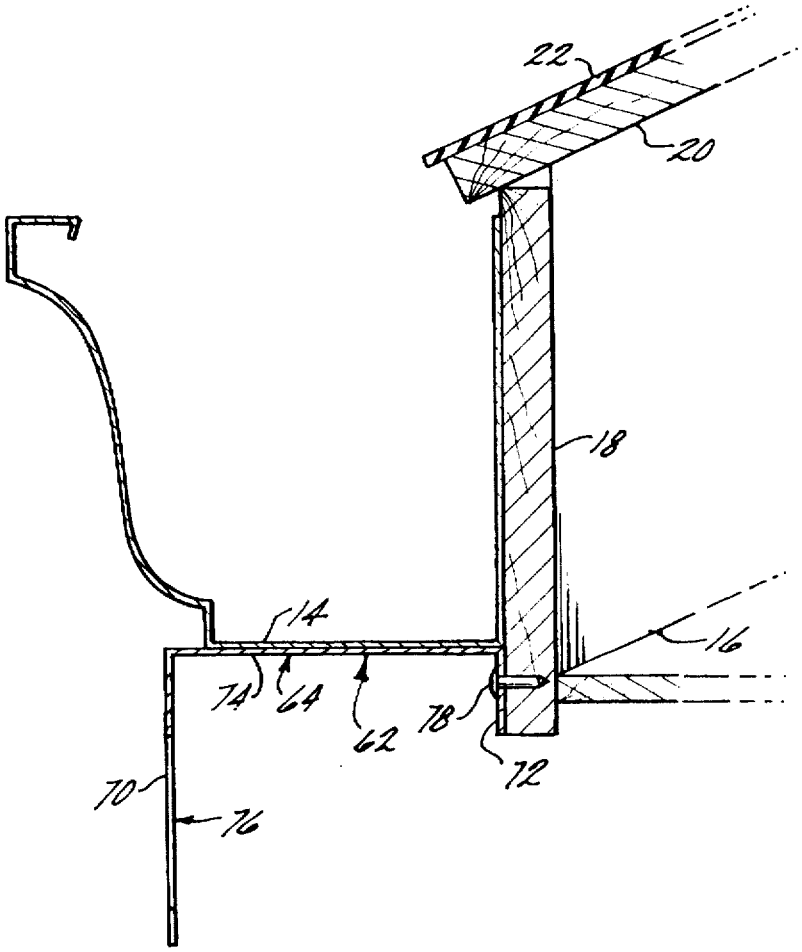
FIG. 7 is a cross sectional view of a strip of gutter decoration attached to a fascia board of a structure in accordance with an alternate embodiment of the present invention.

In accordance with another embodiment of the present invention, referring to FIGS. 7 and 8, a strip of gutter decoration is shown generally at 62. Decoration 62 comprises a strip or section 64 of a standard length, a plurality of which are piece-wise end-to-end (or seamlessly) attached to fascia board 18. Decoration strip 64 extends horizontally and cross sectionally comprises a generally inverted U-shape including leg panels 70, 72 and interconnecting panel 74. A series or pattern of decorative features 76 are formed in leg panel 70. While decorative features 76 are the same as decorative features 28, described above, it will be appreciated that this example is only exemplary and many other decorative features may be employed by and are within the scope of the present invention, as such will readily come to mind to one of ordinary skill in the art.

A plurality of fasteners 78 are provided as a means for attaching decoration strip 64 (at leg portion 72) to fascia board 18. Fasteners 78 may comprise nails, screws, or any other suitable type fasteners. Alternatively, the decoration strip may be attached to fascia board 18 by a suitable adhesive. Further, decoration strip 64 may be attached to gutter 14 at panel 74 by any of the means described above, whereby leg portion 72 may be eliminated.

Decorative strip 64 is preferably formed from a flat sheet of aluminum which is stamped to the configurations described herein, as is well known in the art. Alternatively, decorative strip 64 is formed by vinyl extrusion, or any other suitable means.

Figure 10:
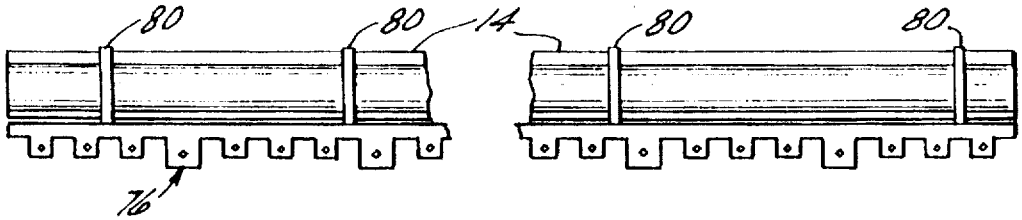
FIG. 10 is a front elevational view of a portion of the strip of gutter decoration attached by the straps to the gutter of FIG. 9 in accordance with an alternate embodiment of the present invention.
Figure 9:
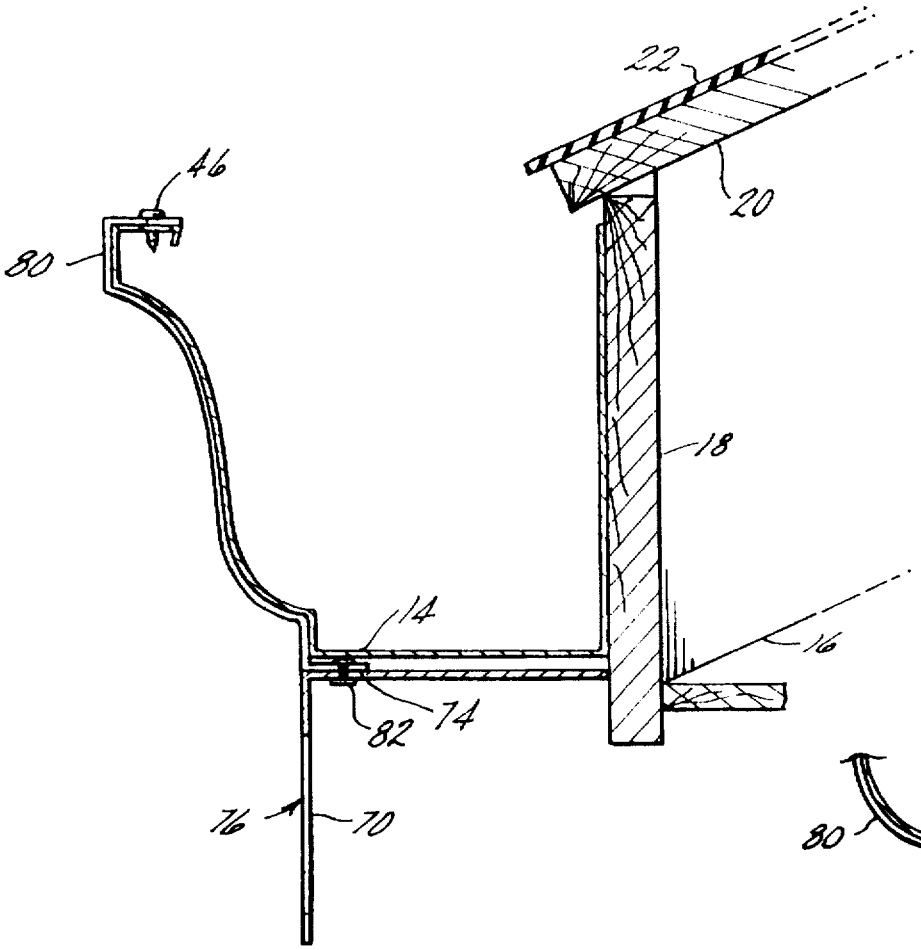
FIG. 9 is a cross sectional view of a strip of gutter decoration attached by a plurality of straps to a gutter mounted to a structure in accordance with an alternate embodiment of the present invention.
Figure 11:
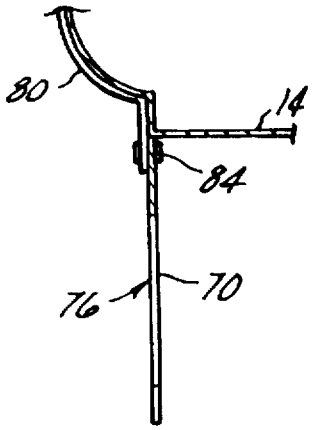
FIG. 11 is a partial cross sectional view of the strip of gutter decoration attached by a plurality of straps to a gutter mounted to a structure in accordance with an alternate embodiment of the present invention.

Decorative strip 64 may be attached to gutter 14 by a series of spaced apart fastening straps 80 (FIGS. 9 and 10). Straps 80 generally follow the contour of gutter 14 and are attached thereto by suitable fasteners or clip means, such as described herein for attachment to gutter 14. The lower end of each strap 80 is attached to panel 74 by fasteners 82 (such as described herein), in which case leg panel 72 may be eliminated. Alternatively, the lower end of each strap 80 is attached to leg panel 70 by fastener 84, in which case panels 72 and 74 may be eliminated leaving only panel 70 (FIG. 11).

Figure 12:
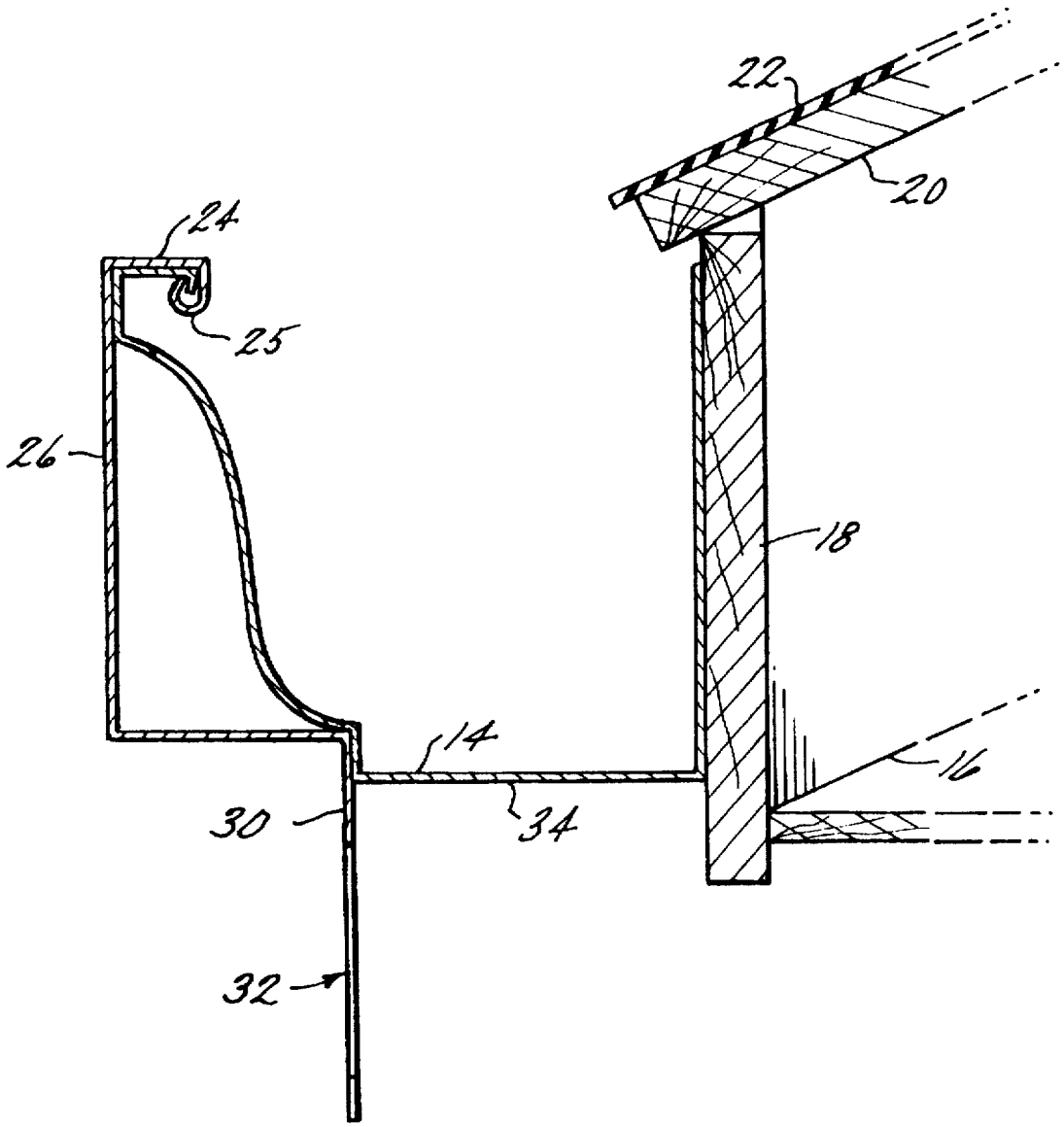
FIG. 12 is a cross sectional view of the strip of gutter decoration attached to a gutter mounted to a structure in accordance with an alternate embodiment of the present invention.

Referring now to FIG. 12, which is another embodiment of decoration strip 12, wherein section 28 is L-shaped instead of roughly following the contour of gutter 14.

While preferred embodiments have been shown and described, various modifications and substitutions may be made thereto without departing from the spirit and scope of the invention. Accordingly, it is to be understood that the present invention has been described by way of illustrations and not limitation.

I claim:

1. A decorative device for a gutter, comprising:

an elongated strip, said elongated strip cross sectionally having, (1) a first vertical portion, and (2) a second portion depending generally upwardly from said first portion, a series of cut outs in said first portion of said elongated strip; and means for fastening said elongated strip to the gutter.

2. The device of claim 1 wherein said means for fastening comprises:

an inverted U-shaped channel depending generally upwardly from said second portion, whereby said inverted U-shaped channel is disposed over an outer upper end of the gutter for attaching said elongated strip to the gutter.

3. The device of claim 1 wherein said series of cut outs comprises:

a repeating series of cut out tabs.

4. The device of claim 3 wherein said tabs further include shaped cut outs therein.

5. The device of claim 4 wherein said shaped cut outs are diamond shaped cut outs.

6. The device of claim 1 wherein said series of cut outs comprises:

a series of cut out scallops.

7. The device of claim 1 wherein said elongated strip is comprised of aluminum.

8. The device of claim 1 wherein said elongated strip is comprised of vinyl.

9. The device of claim 1 wherein said second portion is generally L-shaped.

10. A decorative device for a gutter, comprising:

an elongated strip, said elongated strip cross sectionally having a first vertical panel;

a series of cut outs in said first panel; and means for fastening said elongated strip relative to the gutter.

11. The device of claim 10 wherein said series of cut outs comprises:

a repeating series of cut out tabs.

12. The device of claim 11 wherein said tabs further include shaped cut outs therein.

13. The device of claim 12 wherein said shaped cut outs are diamond shaped cut outs.

14. The device of claim 10 wherein said series of cut outs comprises:

a series of cut out scallops.

15. The device of claim 10 wherein said elongated strip is comprised of aluminum.

16. The device of claim 10 wherein said elongated strip is comprised of vinyl.

* * * * *